United States Patent [19]

Meade et al.

[11] Patent Number: 4,510,416

[45] Date of Patent: Apr. 9, 1985

[54] FILAMENT SUPPORT FOR TUBULAR LAMP

[75] Inventors: Steven L. Meade, Winchester; Merle E. Morris; Lawrence M. Rice, both of Lexington, all of Ky.

[73] Assignee: GTE Products Corporation, Stamford, Conn.

[21] Appl. No.: 515,745

[22] Filed: Jul. 21, 1983

[51] Int. Cl.[3] ..... H01K 1/14

[52] U.S. Cl. ..... 313/579; 313/580; 313/255; 313/258

[58] Field of Search ..... 313/578, 579, 580, 635, 313/255, 258

[56] References Cited

U.S. PATENT DOCUMENTS

| | | | |
|---|---|---|---|
| 2,813,993 | 11/1957 | Fridrich | 313/279 |
| 3,194,999 | 7/1965 | Heinlen | 313/271 |
| 3,195,000 | 7/1965 | Reidenbach | 313/271 |
| 3,538,374 | 11/1970 | Kane | 313/578 |
| 3,736,455 | 5/1973 | Notelteirs et al. | 313/274 |
| 3,820,207 | 6/1974 | Shanks | 313/279 X |
| 4,159,438 | 6/1979 | Ooms et al. | 313/579 |
| 4,310,782 | 1/1982 | Owens et al. | 313/271 |

FOREIGN PATENT DOCUMENTS

| | | | |
|---|---|---|---|
| 966545 | 4/1975 | Canada | 313/579 |

*Primary Examiner*—Arthur Kellogg
*Attorney, Agent, or Firm*—Lawrence R. Fraley

[57] ABSTRACT

A filament support for a helically coiled filament of a tubular double-ended incandescent lamp in which the support is in the form of a wire having a first end portion extending in a loop which is circumferentially engageable with the inner wall of the envelope, a second end portion extending substantially axially of the tubular envelope and defining an inner power lead conductively coupled to a lead-in conductor, a third portion adjacent the first portion and defining several coils each of an outer diameter less than the diameter of the first portion loop and having an inner diameter dimensioned to snugly receive an end of the helically coiled filament, and a fourth portion disposed intermediate the second and third portions and having a turned section forming an abutment which limits the position of the filament relative to the filament support.

10 Claims, 3 Drawing Figures

FILAMENT SUPPORT FOR TUBULAR LAMP

TECHNICAL FIELD

The present invention relates in general to electric incandescent lamps, and pertains, more particularly to tubular lamps having an axially extending coiled filament. Still more particularly, the invention relates to filament supports for elongated tubular envelope lamps of the double-ended type with a coiled filament.

BACKGROUND

A general problem encountered in the manufacture of elongated incandescent tubular lamps using a coiled filament is that of providing proper centering support for the filament. In tubular lamps of the double-ended type having an axially extending filament, particularly one possessing a relatively large diameter and connected at its opposite ends to lead-in conductors sealed through respective opposite ends of the envelope, it has been the practice to provide either a threaded or a tapered insert with associated ring spacer. Each of these in turn is located at one end of the filament to support the filament from the envelope walls and maintain the filament generally at the axis of the tubular envelope. The insert typically has one end secured to the lamp sealing foil and has either the threaded or tapered portion at the other end. The ring spacer is a separate piece secured to the insert, typically at the mid-point thereof. The threaded or tapered portion is adapted to fit within an end of the helically coiled filament.

The filament support comprised of an insert and associated ring spacer has certain disadvantages associated therewith. Because of the use of two separate parts, there is an extra step involved in assembly and welding these parts together. Furthermore, the welded junction creates oxide clean-up problems. Also, because the insert is disposed within the filament coil end, the depth of insertion into the filament is difficult to control and measure because the insert is essentially out-of-sight within the filament coil. This creates variations in insertion depth which is a major factor in inconsistencies in lamp performance.

A number of prior art techniques exist for providing filament support in tubular lamps. For example, U.S. Pat. Nos. 3,736,455 and 3,820,207 show filament support structures. However, these support structures are not primarily for end filament support and it is noted that in both of these references, the support member requires separate connection to the glass seal. For example, in U.S. Pat. No. 3,736,455, it is noted that at each end of the lamp there are utilized (and required) two support foils.

In U.S. Pat. Nos. 2,813,993, 3,194,999, 3,195,000; and 4,310,782, there are illustrated filament supports that are basically in the form of a support ring, usually disposed at either an intermediate position or at spaced positions along the filament. These support rings do not provide for both filament support and insertion depth control. Moreover, these patents do not show a filament support that is of single-piece integral construction and that additionally forms an inner power lead.

DISCLOSURE OF THE INVENTION

It is an object of the present invention to provide an improved filament support for tubular lamps, particularly double-ended lamps.

It is a further object of the present invention to provide an improved filament termination (support), preferably for double-ended lamps and which provides, in addition to filament support, filament centering, insertion depth control, and yet is also able to provide an inner power lead.

Another objeet of the present invention is to provide an improved filament support for tubular lamps and in which the filament support is of single-piece construction, thus eliminating the need for welding of separate parts to form the overall support member.

A further object of the present invention is to provide an improved filament support for tubular lamps which provides for the construction of lamps having more improved and consistent performance.

Still another object of the present invention is to provide an improved filament support for tubular lamps in accordance with the preceding object and in which consistency of performance is attained, at least in part by the capability of setting filaments from lamp-to-lamp at the same insertion depth.

Still a further object of the present invention is to provide an improved filament support for tubular lamps, particularly double-ended type lamps and in which the assembly of the lamp parts is accomplished in a more simplified manner and thus at lower labor costs.

In accordance with the present invention, there is provided an improved filament support for use in an electric incandescent lamp preferably of the double-ended type which includes a tubular envelope sealed at each end, a helically coiled filament extending through the interior of the envelope, and lead-in conductor means at respective sealed ends of the tubular envelope and partially extending to the exterior so as to enable electrical connection to the lamp. In accordance with the invention, the filament support is in the form of a wire, preferably of tungsten, having multiple portions including a first portion extending in a loop which is circumferentially engageable with the inner wall of the envelope around at least one half of the circumference thereof, and a second portion extending substantially axially of the tubular envelope and defining an inner power lead conductively coupled to the lead-in conductor means. The second end portion is preferably straight and coincident with the center axis of the tube or envelope. The first and second portions are preferably disposed at remote ends of the filament support. The filament support also comprises a third portion adjacent the first portion and having means defining at least one coil of outer diameter less than the diameter of the first portion loop and having an inner diameter dimensioned to snugly receive an end of the helically coiled filament. A fourth portion is disposed intermediate the second and third portions and has a turned section forming an abutment for limiting the position of the filament relative to the filament support. It is preferred that the third portion have multiple coils defining a recess of predetermined depth. The multiple third portion coils are helically wound to match the helically coiled filament so as to enable the filament to be threaded into the multiple third portions coils having a sufficiently tight fit therebetween to impart good electrical contact. The turned section extends from a point outside of the center axis of the envelope transversely to a point on the center axis of the envelope.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
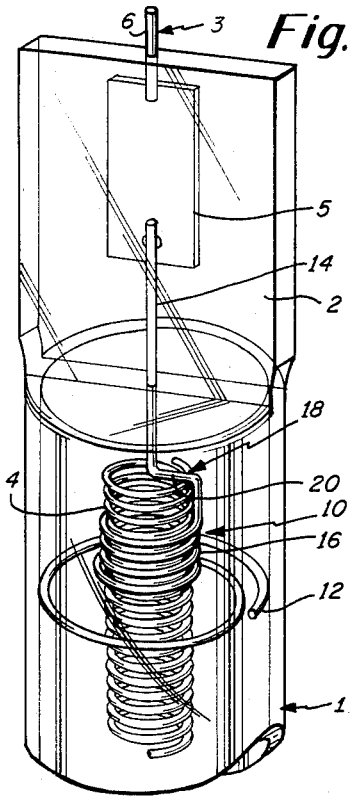
FIG. 1 is a side perspective view of a lamp having a filament support in accordance with the present invention.
Figure 2:
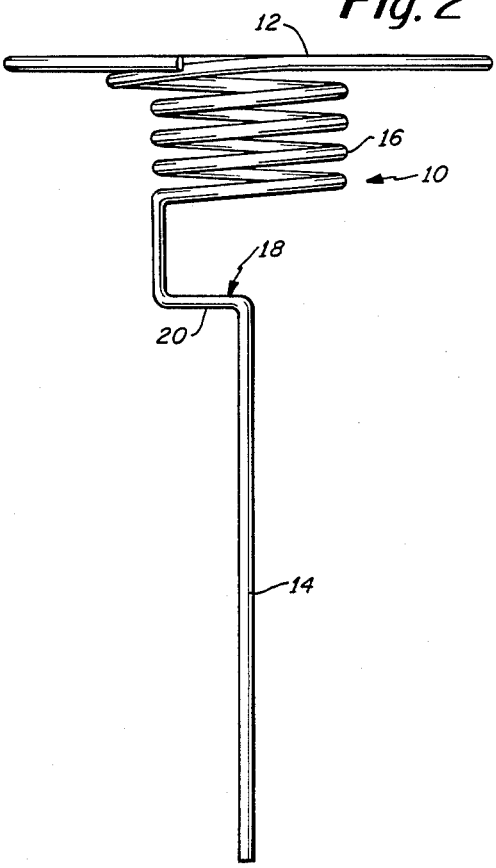
FIG. 2 is a side view of the preferred filament support standing alone.
Figure 2:
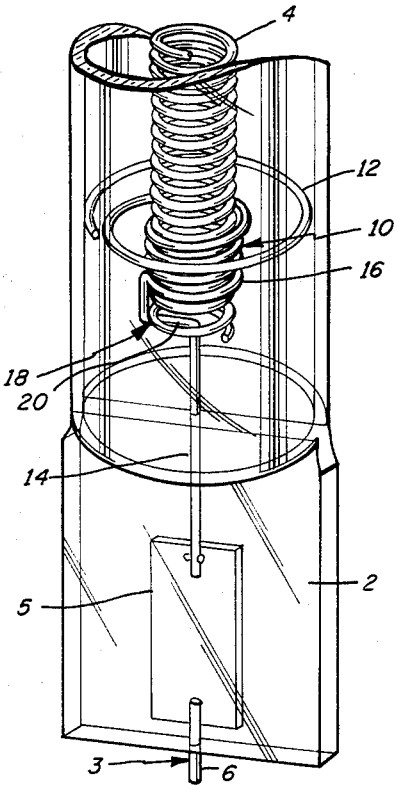
Figure 3:
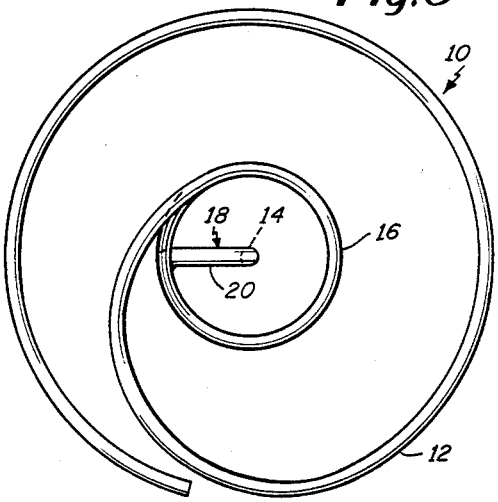
FIG. 3 is a top plan view of the filament support of FIG. 2.

Referring now to FIGS. 1–3, the lamp illustrated therein comprises a tubular envelope 1 of vitreous material having compressed pinch seals 2 at its opposite ends through which extend lead-in conductors 3. FIG. 1 also shows the helically coiled filament 4 which extends longitudinally through the interior of the envelope. The lamp may be of the so-called tungsten-halogen type, wherein the filament 4 is of tungsten wire and the envelope 1 contains a halogen additive, such as iodine or bromine, which functions as a regenerative getter to return tungsten to the filament which has been vaporized therefrom during operation of the lamp. The envelope preferably also contains a filling of inert gas such as nitrogen, argon, krypton or xenon at substantial pressure, preferably exceeding atmospheric pressure. Since the envelope of such a lamp during operation attains elevated temperatures exceeding 250° C., it is preferably made of light-transmitting material of relatively high melting point such as fused silica or quartz. High melting point glasses such as borosilicate or aluminosilicate may also be used. Each of the lead-in conductors 3 includes a flat foil portion 5 (preferably molybdenum) which is hermetically sealed in the pinch seal 2 along with an outer portion 6 which is also preferably constructed of molybdenum.

The filament support (termination) in accordance with the present invention is in the form of a wire member 10 (preferably of tungsten) including multiple portions to be described hereinafter. As illustrated in FIG. 1, the filament termination is preferably for use with a double-ended lamp. The filament termination 10 has multiple function use. In addition to functioning as a filament support, it provides for filament centering, assures insertion depth control, and also defines as an inner power lead. The concepts of this invention are adapted in particular for use with lamps having large diameter filaments; that is diameters wherein straight and/or threaded rods become impractical to use.

The filament support (or termination) 10 has multiple portions including a first end portion extending in a loop 12 which is circumferentially engageable with the inner wall of the envelope. This loop extends around at least one-half of the inner circumference of the tube and preferably extends substantially around the entire inner circumference as depicted in FIG. 1. At the opposite end of the filament support there is provided a second end portion including a straight section 14 that extends substantially axially of the tubular envelope and which defines an inner power lead that is conductively coupled to foil 5. The straight section 14 of the filament support, as well as the outer portion 6 of the lead-in conductor 3, is secured to foil 5 in a conventional, suitable manner.

The two end portions of the filament support are interconnected by a third portion which is adjacent to the loop 12 and has means defining preferably a plurality of smaller diameter coils 16 having a coil diameter less than the diameter of the loop 12 and having an inner diameter dimensioned to snugly receive an end of the helically coiled filament 4 in the manner illustrated in FIG. 1. Finally, there is provided a fourth portion of the filament support disposed intermediate the multiple coils 16 and the straight section 14. This is shown in the drawing in the form of a turned section 18 having a transverse abutment 20 for limiting the position of the filament 4 relative to the filament support.

The coils 16 are constructed so as to match the helically coiled filament 4 to enable the filament to be threaded into these coils with a sufficiently tight fit therebetween and thus impart good electrical contact. This physically close fit is accomplished by approximately matching the T.P.I. (turns per inch) of the filament support to the T.P.I. of the lamp filament 4. This snug physical fit is also accomplished by winding the coils to a diameter which allows the lamp filament 4 to be threaded through the coils and bottom out against the abutment 20. It is noted that the turned section 18 extends from a point outside of the center axis of the envelope transversely (by means of the abutment 20) to a point substantially on the center axis of the envelope. It is also noted that the straight section 14 is coincident with the center axis of the tubular envelope and thereby also coincident with the center axis of the filament 4.

The filament support of the present invention centers the lamp filament 4 axially in the lamp envelope in at least three different ways, these being:

1. Loop 12 is formed in a manner so that it is capable of compressing or expanding so as to be accommodated in a range of different diameter tubular envelopes, as is often encountered in the manufacturing process;
2. The filament support holds the ends of the filament 4 in a centered manner by axial transfer of stress imparted to the filament through the sealing foil 5; and
3. The filament support holds the filament ends centered by counteracting the glass flow side torques imparted to the filament ends from the pinch seal operation. The countering effect is accomplished by physically supporting the ends of the assembly by way of the tubular envelope wall contact.

In accordance with the assembly procedure of the present invention, two filament supports 10 of the form illustrated in FIGS. 2 and 3 are engaged outside of the tubular envelope with the opposite ends of the filament 4. The filament supports are in essence, screwed onto the ends of the filament until the filament ends bottom out against the respective abutment 20. The assembly of filament and end filament supports is then inserted into the tubular envelope 1. The loop 12 associated with each filament support is slightly compressed so as to provide a fixed and secured position of the filament and associated supports within the tubular envelope. With the filament supports engaged with the filament 4, the supports are each respectively secured to their associated foil 5 and outer portion conductor 6. Once in place, a conventional pinch sealing operation is then used to provide the end pinch seals 2. It is understood that the aforedescribed inert gas and halogen additive are added prior to totally sealing the envelope.

While there have been shown and described what are at present considered the preferred embodiments of the invention, it will be obvious to those skilled in the art that various changes and modifications may be made therein without departing from the scope of the invention as defined by the appended claims. For example, the coils 16, rather than being on the same side of the loop 12 as the straight section 14, could be located on the opposite side of the loop 12 remote from the straight section 14.

What is claimed is:

1. In an electric incandescent lamp of the double-ended type including a tubular envelope sealed at each end thereof, a helically coiled filament extending longitudinally through the interior of said envelope, and lead-in conductor means located at each of said sealed ends of said tubular envelope and extending exteriorly thereof, the improvement comprising;

a filament support in the form of a wire having a first end portion extending in a loop which is circumferentially engageable with the inner wall of said envelope around at least one-half of the circumference thereof, a second end portion extending substantially axially of said envelope and defining an inner power lead conductively coupled to one of said lead-in conductor means, a third portion adjacent said first portion and defining at least one coil of outer diameter less than the diameter of said first portion loop and having an inner diameter dimensioned to snugly receive an end of said helically coiled filament, and a fourth portion disposed intermediate said second and third portions and having a turned section forming an abutment for limiting the position of said filament relative to said filament support.

2. The improvement according to claim 1 wherein said third portion has multiple coils defining a recess of predetermined depth.

3. The improvement according to claim 2 wherein said multiple third portion coils are helically wound to match the helically coiled filament so as to enable said filament to be threaded into said multiple third portion coils in a sufficiently tight fit therebetween to impart good electrical contact.

4. The improvement according to claim 1 wherein said first portion loop engages said inner wall of said envelope substantially about the entire circumference thereof.

5. The improvement according to claim 1 wherein said second portion is straight and coincident with the center axis of said tubular envelope.

6. The improvement according to claim 1 wherein said first portion is disposed at an end of the support remote from said second end portion.

7. The improvement according to claim 1 wherein said turned third portion extends from a point outside of the center axis of said envelope transversely to a point on the center axis of said envelope.

8. The improvement according to claim 1 wherein said coiled filament and said support wire are tungsten.

9. The improvement according to claim 1 wherein said envelope is quartz and contains a fill of an inert gas and halogen.

10. The improvement according to claim 1 wherein the number of said filament supports is two, each of said supports located at a respective end of said tubular envelope and electrically connected to a respective one of said lead-in conductor means.

* * * * *